US008597466B2

(12) United States Patent
Esser et al.

(10) Patent No.: US 8,597,466 B2
(45) **Date of Patent: *Dec. 3, 2013**

(54) PROCESS FOR THE PRODUCTION OF PAPER, BOARD AND CARDBOARD HAVING HIGH DRY STRENGTH

(75) Inventors: Anton Esser, Limburgerhof (DE); Hans-Joachim Haehnle, Neustadt (DE)

(73) Assignee: BASF SE, Ludwigshafen (DE)

( * ) Notice: Subject to any disclaimer, the term of this patent is extended or adjusted under 35 U.S.C. 154(b) by 243 days.

This patent is subject to a terminal disclaimer.

(21) Appl. No.: 12/990,763

(22) PCT Filed: May 14, 2009

(86) PCT No.: PCT/EP2009/055837

§ 371 (c)(1), (2), (4) Date: Nov. 2, 2010

(87) PCT Pub. No.: WO2009/138457

PCT Pub. Date: Nov. 19, 2009

(65) Prior Publication Data

US 2011/0048660 A1 Mar. 3, 2011

(30) Foreign Application Priority Data

May 15, 2008 (EP) ..... 08156244
Jan. 8, 2009 (EP) ..... 09150237

(51) Int. Cl.
*D21H 11/00* (2006.01)

(52) U.S. Cl.
USPC ..... 162/164.5

(58) Field of Classification Search
USPC ..... 162/164.5, 164.1, 164.6, 164.7
See application file for complete search history.

(56) References Cited

U.S. PATENT DOCUMENTS

| | | | | |
|---|---|---|---|---|
| 5,185,062 | A * | 2/1993 | Begala | 162/168.1 |
| 5,338,406 | A * | 8/1994 | Smith | 162/168.2 |
| 6,410,004 | B1 | 6/2002 | Kim et al. | |
| 7,074,845 | B2 * | 7/2006 | Laleg | 524/47 |
| 2003/0188840 | A1 * | 10/2003 | Van Handel et al. | 162/164.1 |
| 2010/0010153 | A1 | 1/2010 | Feuerhake et al. | |
| 2010/0179248 | A1 | 7/2010 | Esser et al. | |
| 2010/0181037 | A1 | 7/2010 | Esser et al. | |
| 2010/0181038 | A1 | 7/2010 | Esser et al. | |
| 2010/0186915 | A1 | 7/2010 | Esser et al. | |
| 2011/0230601 | A1 | 9/2011 | Nieberle et al. | |

FOREIGN PATENT DOCUMENTS

| | | |
|---|---|---|
| CA | 1 110 019 | 10/1981 |
| DE | 35 06 832 | 8/1986 |
| DE | 10 2005 029010 | 12/2006 |
| EP | 0 438 744 | 7/1991 |
| WO | 2004 061235 | 7/2004 |
| WO | 2006 056381 | 6/2006 |
| WO | WO 2006/123989 | 11/2006 |

OTHER PUBLICATIONS

U.S. Appl. No. 12/996,688, filed Dec. 7, 2010, Haehnle, et al.
International Search Report issued Aug. 5, 2009 in PCT/EP09/55837 filed May 14, 2009.
U.S. Appl. No. 13/502,885, filed Apr. 19, 2012, Esser.
U.S. Appl. No. 13/376,509, filed Dec. 6, 2011, Jehn-Rendu, et al.
U.S. Appl. No. 13/058,217, filed Feb. 9, 2011, Haehnle, et al.
U.S. Appl. No. 13/147,623, filed Aug. 3, 2011, Esser, et al.

* cited by examiner

*Primary Examiner* — Mark Halpern
(74) *Attorney, Agent, or Firm* — Oblon, Spivak, McClelland, Maier & Neustadt, L.L.P.

(57) ABSTRACT

Process for the production of paper, board and cardboard having high dry strength by separate addition of a water-soluble cationic polymer and of an aqueous dispersion of a water-insoluble polymer having a content of acid groups of not more than 10 mol % or of an aqueous dispersion of a nonionic polymer, which dispersion has been made anionic, to a paper stock, draining of the paper stock and drying of the paper products. Preferably, the polymers are added to a paper stock which has a temperature of at least 40° C.

20 Claims, No Drawings

PROCESS FOR THE PRODUCTION OF PAPER, BOARD AND CARDBOARD HAVING HIGH DRY STRENGTH

This application is a 371 of PCT/EP09/55837 filed 14 May 2009.

The invention relates to a process for the production of paper, board and cardboard having high dry strength by addition of water-soluble cationic polymers and anionic polymers to a paper stock, draining of the paper stock and drying of the paper products.

In order to increase the dry strength of paper, a dry strength agent can either be applied to the surface of already dried paper or added to a paper stock prior to sheet formation. The dry strength agents are usually used in the form of a 1 to 10% strength aqueous solution. If such a solution of a dry strength agent is applied to the surface of paper, considerable amounts of water must be evaporated in the subsequent drying process. Since the drying step is very energy-intensive and since the capacity of the customary drying apparatuses on paper machines is in general not so large that it is possible to operate at the maximum possible production speed of the paper machine, the production speed of the paper machine must be reduced in order for the paper treated with the dry strength agent to be dried to a sufficient extent.

If, on the other hand, the dry strength agent is added to a paper stock prior to the sheet formation, the treated paper may be dried only once. DE-A-35 06 832 discloses a process for the production of paper having high dry strength, in which first a water-soluble cationic polymer and then water-soluble anionic polymer are added to the paper stock. In the examples, polyethyleneimine, polyvinylamine, polydiallyldimethylammonium chloride and epichlorohydrin crosslinked condensates of adipic acid and diethylenetriamine are described as water-soluble cationic polymers. For example homo- or copolymers of ethylenically unsaturated $C_3$- to $C_5$-carboxylic acids are suitable as water-soluble anionic polymers. The copolymers comprise, for example, from 35 to 99% by weight of an ethylenically unsaturated $C_3$- to $C_5$-carboxylic acid, such as, for example, acrylic acid, incorporated in the form of polymerized units.

WO-A-2004/061235 discloses a process for the production of paper, in particular tissue, having particularly high wet and/or dry strengths, in which first a water-soluble cationic polymer which comprises at least 1.5 meq of primary amino functionalities per g of polymer and has a molecular weight of least 10 000 dalton is added to the paper stock. Particularly singled out here are partly and completely hydrolyzed homopolymers of N-vinylformamide. Thereafter, a water-soluble anionic polymer which comprises anionic and/or aldehydic groups is added. Especially the variability of the two-component systems described, with regard to various paper properties, including wet and dry strength, is emphasized as an advantage of this process.

WO-A-2006/056381 discloses a process for the production of paper, board and cardboard having high dry strength a separate addition of a water-soluble polymer comprising vinylamine units and of a water-soluble polymeric anionic compound to a paper stock, draining of the paper stock and drying of the paper products, the polymeric anionic compound used being at least one water-soluble copolymer which is obtainable by copolymerization of at least one N-vinylcarboxamide of the formula

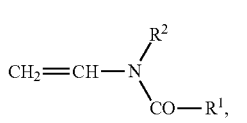

(I)

where $R^1$, $R^2$ are H or $C_1$- to $C_6$-alkyl, at least one monoethylenically unsaturated monomer comprising acid groups and/or the alkali metal, alkaline earth metal or ammonium salts thereof and, if appropriate, other monoethylenically unsaturated monomers and, if appropriate, compounds which have at least two ethylenically unsaturated double bonds in the molecule.

It is the object of the invention to provide a further process for the production of paper having high dry strength and wet strength which is as low as possible, the dry strength of the paper products being further improved as far as possible compared with the prior art.

The object is achieved, according to the invention, by a process for the production of paper, board and cardboard having high dry strength by separate addition of a water-soluble cationic polymer and of an anionic polymer to a paper stock, draining of the paper stock and drying of the paper products, if an aqueous dispersion of a water-insoluble polymer having a content of acid groups of not more than 10 mol % or an aqueous dispersion of a nonionic polymer, which dispersion has been made anionic, is used as the anionic polymer.

While the cationic polymer is added to the paper stock in the form of diluted aqueous solutions having a polymer content of, for example, from 0.1 to 10% by weight, the addition of the anionic polymer is always effected as an aqueous dispersion. The polymer concentration of the aqueous dispersion can be varied within a wide range. Preferably, the aqueous dispersions are metered in dilute form; for example, the polymer concentration of the anionic dispersions is from 0.5 to 10% by weight.

Anionic Polymers

The anionic polymers dispersed in water are practically insoluble in water. Thus, for example, at a pH of 7.0 under standard conditions (20° C., 1013 mbar), the solubility is not more than 2.5 g of polymer/liter of water, in general not more than 0.5 g/l and preferably not more than 0.1 g/l. Owing to the content of acid groups in the polymer, the dispersions are anionic. The water-insoluble polymer has, for example, a content of acid groups of from 0.1 to 10 mol %, in general from 0.5 to 9 mol % and preferably from 0.5 to 6 mol %, in particular from 2 to 6 mol %. The content of acid groups in the anionic polymer is in general from 2 to 4 mol %.

The acid groups of the anionic polymer are selected, for example, from carboxyl, sulfo and phosphonic acid groups. Carboxyl groups are particularly preferred here.

The anionic polymers comprise, for example, (a) at least one monomer from the group consisting of $C_1$- to $C_{20}$-alkyl acrylates, $C_1$- to $C_{20}$-alkyl methacrylates, vinyl esters of saturated carboxylic acids comprising up to 20 carbon atoms, vinylaromatics having up to 20 carbon atoms, ethylenically unsaturated nitriles, vinyl ethers of saturated, monohydric alcohols comprising 1 to 10 carbon atoms, vinyl halides and aliphatic hydrocarbons having 2 to 8 carbon atoms and one or two double bonds, (b) at least one anionic monomer from the group consisting of the ethylenically unsaturated $C_3$- to $C_8$-carboxylic acids, vinylsulfonic acid, acrylamido-2-methylpropanesulfonic acid, styrenesulfonic acid, vinylphosphonic acid and the salts thereof and, if appropriate, (c) at least one monomer from the group consisting of the $C_1$- to $C_{10}$-hydroxyalkyl acrylates, $C_1$- to $C_{10}$-hydroxyalkyl methacrylates, acrylamide, methacrylamide, N—$C_1$- to $C_{20}$-alkylacrylamides and N—$C_1$- to $C_{20}$-alkylmethacrylamides and, if appropriate, (d) at least one monomer having at least two ethylenically unsaturated double bonds in the molecule incorporated in the form of polymerized units.

The anionic polymers comprise, for example, at least 40 mol %, preferably at least 60 mol % and in particular at least 80 mol % of at least one monomer of group (a) incorporated in the form of polymerized units. These monomers are practically water-insoluble or give water-insoluble polymers in a homopolymerization carried out therewith.

The anionic polymers preferably comprise, as a monomer of group (a), mixtures of (i) a $C_1$- to $C_{20}$-alkyl acrylate and/or a $C_1$- to $C_{20}$-alkyl methacrylate and (ii) styrene, α-methylstyrene, p-methylstyrene, α-butylstyrene, 4-n-butylstyrene, butadiene and/or isoprene in the weight ratio of from 10:90 to 90:10 incorporated in the form of polymerized units.

Examples of individual monomers of group (a) of the anionic polymers are acrylates or methacrylates of saturated, monohydric $C_1$- to $C_{20}$-alcohols such as methyl acrylate, methyl methacrylate, ethyl acrylate, ethyl methacrylate, n-propyl acrylate, n-propyl methacrylate, isopropyl acrylate, n-butyl acrylate, sec-butyl acrylate, tert-butyl acrylate, n-butyl methacrylate, sec-butyl methacrylate, tert-butyl methacrylate, n-pentyl acrylate, n-pentyl methacrylate, n-hexyl acrylate, n-hexyl methacrylate, cyclohexyl acrylate, cyclohexyl methacrylate, 2-ethylhexyl acrylate, 2-ethylhexyl methacrylate, n-octyl acrylate, n-octyl methacrylate, n-decyl acrylate, n-decyl methacrylate, dodecyl acrylate, dodecyl methacrylate, lauryl acrylate, lauryl methacrylate, palmityl acrylate, palmityl methacrylate, stearyl acrylate and stearyl methacrylate. Among these monomers, the esters of acrylic acid and the methacrylic acid with saturated, monohydric $C_1$- to $C_{10}$-alcohols are preferably used. Mixtures of these monomers are also used in the preparation of the anionic polymers, for example mixtures of n-butyl acrylate and ethyl acrylate or mixtures of n-butyl acrylate and at least one propyl acrylate.

Further monomers of group (a) of the anionic polymers are:

vinyl esters of saturated carboxylic acids having 1 to 20 carbon atoms, e.g. vinyl laurate, vinyl stearate, vinyl propionate, vinyl versatate and vinyl acetate, vinylaromatic compounds, such as styrene, α-methylstyrene, p-methylstyrene, α-butylstyrene, 4-n-butylstyrene and 4-n-decylstyrene, nitriles, such as acrylonitrile and methacrylonitrile, vinyl halides, such as ethylenically unsaturated compounds substituted by chlorine, fluorine or bromine, preferably vinyl chloride and vinylidene chloride, vinyl ethers, e.g. vinyl ethers of saturated alcohols comprising 1 to 4 carbon atoms, such as vinyl methyl ether, vinyl ethyl ether, vinyl-n-propyl ether, vinyl isopropyl ether, vinyl-n-butyl ether or vinyl isobutyl ether, and aliphatic hydrocarbons having one or two olefinic double bonds and 2 to 8 carbon atoms, such as ethylene, propylene, butadiene, isoprene and chloroprene.

Preferred monomers of group (a) are $C_1$-$C_{20}$-alkyl(meth) acrylates and mixtures of the alkyl(meth)acrylates with vinylaromatics, in particular styrene and/or hydrocarbons having two double bonds, in particular butadiene, or mixtures of such hydrocarbons with vinylaromatics, in particular styrene. Particularly preferred monomers of group (a) of the anionic polymers are n-butyl acrylate, styrene and acrylonitrile, which in each case can be used alone or as a mixture. In the case of monomer mixtures, the weight ratio of alkyl acrylates or alkyl methacrylates to vinylaromatics and/or to hydrocarbons having two double bonds, such as butadiene, will be, for example, from 10:90 to 90:10, preferably from 20:80 to 80:20.

Examples of anionic monomers of group (b) of the anionic polymers are ethylenically unsaturated $C_3$- to $C_8$-carboxylic acids, such as, for example, acrylic acid, methacrylic acid, dimethacrylic acid, ethacrylic acid, maleic acid, fumaric acid, itaconic acid, mesaconic acid, citraconic acid, methylene malonic acid, allyl acetic acid, vinyl acetic acid and crotonic acid. Other suitable monomers of group (b) are monomers comprising sulfo groups, such as vinylsulfonic acid, acrylamido-2-methylpropanesulfonic acid and styrenesulfonic acid, and vinylphosphonic acid. The monomers of this group may be used alone or as a mixture with one another, in partly or in completely neutralized form, in the copolymerization. For example, alkali metal or alkaline earth metal bases, ammonia, amines and/or alkanolamines are used for the neutralization. Examples of these are sodium hydroxide solution, potassium hydroxide solution, sodium carbonate, potassium carbonate, sodium bicarbonate, magnesium oxide, calcium hydroxide, calcium oxide, triethanolamine, ethanolamine, morpholine, diethylenetriamine or tetraethylenepentamine.

The water-insoluble anionic polymers can, if appropriate, comprise at least one monomer from group consisting of $C_1$- to $C_{10}$-hydroxyalkyl acrylates, $C_1$- to $C_{10}$-hydroxyalkyl methacrylates, acrylamide, methacrylamide, N—$C_1$- to $C_{20}$-alkylacrylamides and N—$C_1$- to $C_{20}$-alkylmethacrylamides as further monomers (c). If these monomers are used for modifying the anionic polymers, acrylamide or methacrylamide is preferably used. The amounts of monomers (c) incorporated in the form of polymerized units in the anionic polymer are up to, for example, 20 mol %, preferably up to 10 mol %, and, if these monomers are used in the polymerization, are in the range of from 1 to 5 mol %.

Suitable monomers of group (d) are compounds having at least two ethylenically unsaturated double bonds in the molecule. Such compounds are also referred to as crosslinking agents. They comprise, for example, from 2 to 6, preferably from 2 to 4 and generally 2 or 3 double bonds capable of free radical polymerization in the molecule. The double bonds may be, for example, the following groups: acrylate, methacrylate, vinyl ether, vinyl ester, allyl ether and allyl ester groups. Examples of crosslinking agents are 1,2-ethanediol di(meth)acrylate (here and in the following text, the notation " . . . (meth)acrylate" or "(meth)acrylic acid" means both " . . . acrylate" and " . . . methacrylate" or acrylic acid as well as methacrylic acid), 1,3-propanediol di(meth)acrylate, 1,2-propanediol di(meth)acrylate, 1,4-butanediol di(meth)acrylate, 1,6-hexanediol di(meth)acrylate, neopentylglycol di(meth)acrylate, trimethylolpropanetriol di(meth)acrylate, pentaerythritol tetra(meth)acrylate, 1,4-butanediol divinyl ether, 1,6-hexanediol divinyl ether, 1,4-cyclohexanediol divinyl ether, divinylbenzene, allyl acrylate, allyl methacrylate, methallyl acrylate, methallyl methacrylate, but-3-en-2-yl (meth)acrylate, but-2-en-1-yl(meth)acrylate, 3-methylbut-2-en-1-yl(meth)acrylate, esters of (meth)acrylic acid with geraniol, citronellal, cinnamic alcohol, glyceryl mono- or diallyl ether, trimethylolpropane mono- or -diallyl ether, ethylene glycol monoallyl ether, diethylene glycol monoallyl ether, propylene glycol monoallyl ether, dipropylene glycol monoallyl ether, 1,3-propanediol monoallyl ether, 1,4-butanediol monoallyl ether and furthermore diallyl itaconate. Allyl acrylate, divinylbenzene, 1,4-butanediol diacrylate and 1,6-hexanediol diacrylate are preferred. If a crosslinking agent is used for modifying the polymers, the amounts incorporated in the form polymerized units are up to 2 mol %. They are, for example, in the range from 0.001 to 2, preferably from 0.01 to 1, mol %.

The water-insoluble anionic polymers preferably comprise, as monomers (a), mixtures of 20-50 mol % of styrene and 30-80 mol % of at least one alkyl methacrylate and/or at least one alkyl acrylate incorporated in the form of polymerized units. They can, if appropriate, also comprise up to 30 mol % of methacrylonitrile or acrylonitrile incorporated in the form of polymerized units. Such polymers can, if appropriate, also be modified by the amounts of methacrylamide and/or acrylamide which are stated above under monomers from group (c).

Preferred anionic polymers comprise (a) at least 60 mol % of at least one monomer from the group consisting of a $C_1$- to $C_{20}$-alkyl acrylate, a $C_1$- to $C_{20}$-alkyl methacrylate, vinyl acetate, vinyl propionate, styrene, α-methylstyrene, p-methylstyrene, α-butylstyrene, 4-n-butylstyrene, 4-n-decylstyrene, acrylonitrile, methacrylonitrile, butadiene and isoprene and (b) from 0.5 to 9 mol % of at least one anionic monomer from the group consisting of the ethylenically unsaturated $C_3$- to $C_5$-carboxylic acids incorporated in the form of polymerized units.

Anionic polymers which comprise at least 80 mol % of at least one monomer of group (a) incorporated in the form of polymerized units are particularly preferred. They generally comprise, as a monomer of group (a), mixtures of (i) a $C_1$- to $C_{20}$-alkyl acrylate and/or a $C_1$- to $C_{20}$-alkyl methacrylate and (ii) styrene, α-methylstyrene, p-methylstyrene, α-butylstyrene, 4-n-butylstyrene, butadiene and/or isoprene in the weight ratio of from 10:90 to 90:10 incorporated in the form of polymerized units.

The preparation of the anionic polymers is effected as a rule by emulsion polymerization. The anionic polymers are therefore emulsion polymers. The preparation of aqueous polymer dispersions by the free radical emulsion polymerization process is known per se (cf. Houben-Weyl, Methoden der organischen Chemie, volume XIV, Makromolekulare Stoffe, Georg Thieme Verlag, Stuttgart 1961, page 133 et seq.).

In the emulsion polymerization for the preparation of the anionic polymers, ionic and/or nonionic emulsifiers and/or protective colloids or stabilizers are used as surface-active compounds. The surface-active substance is usually used in amounts of from 0.1 to 10% by weight, in particular from 0.2 to 3% by weight, based on the monomers to be polymerized.

Customary emulsifiers are, for example, ammonium or alkali metal salts of higher fatty alcohol sulfates, such as sodium n-laurylsulfate, fatty alcohol phosphates, ethoxylated $C_8$- to $C_{10}$-alkylphenols having a degree of ethoxylation of from 3 to 30 and ethoxylated $C_8$- to $C_{25}$-fatty alcohols having a degree of ethoxylation of from 5 to 50. Mixtures of nonionic and ionic emulsifiers are also conceivable. Ethoxylated and/or propoxylated alkylphenols and/or fatty alcohols containing phosphate or sulfate groups are furthermore suitable. Further suitable emulsifiers are mentioned in Houben-Weyl, Methoden der organischen Chemie, volume XIV, Makromolekulare Stoffe, Georg Thieme Verlag, Stuttgart, 1961, pages 192 to 209.

Water-soluble initiators for the emulsion polymerization for the preparation of the anionic polymers are, for example, ammonium and alkali metal salts of peroxodisulfuric acid, e.g. sodium peroxodisulfate, hydrogen peroxide or organic peroxides, e.g. tert-butyl hydroperoxide.

So-called reduction-oxidation (redox) initiator systems are also suitable, for example combinations of peroxides, hydroperoxides or hydrogen peroxide with reducing agents, such as ascorbic acid or sodium bisulfite. These initiator systems may additionally comprise metal ions, such as iron(II) ions.

The amount of initiators is in general from 0.1 to 10% by weight, preferably from 0.5 to 5% by weight, based on the monomers to be polymerized. It is also possible to use a plurality of different initiators in the emulsion polymerization.

In the emulsion polymerization, it is possible, if appropriate, to use regulators, for example in amounts of from 0 to 3 parts by weight, based on 100 parts by weight of the monomers to be polymerized. As a result, the molar mass of the resulting polymers is reduced. Suitable regulators are, for example, compounds having a thiol group, such as tert-butyl mercaptan, thioglycolic acid ethyl acrylate, mercaptoethanol, mercaptopropyltrimethoxysilane or tert-dodecyl mercaptan, or regulators without a thiol group, in particular, for example, terpinolene.

The emulsion polymerization for the preparation of the anionic polymers is effected as a rule at from 30 to 130° C., preferably of from 50 to 100° C. The polymerization medium may consist both only of water and of mixtures of water and liquids miscible therewith, such as methanol. Preferably, only water is used. The emulsion polymerization can be carried out both as a batch process and in the form of a feed process, including step or gradient procedure. Preferred is the feed process in which a part of the polymerization batch is initially taken, heated to the polymerization temperature and partly polymerized and then the remainder of the polymerization batch is fed to the polymerization zone continuously, stepwise or with superposition of a concentration gradient while maintaining the polymerization, usually via a plurality of spatially separate feeds, one or more of which comprise the monomers in pure or emulsified form. In the polymerization, a polymer seed may also be initially taken, for example for better adjustment of the particle size.

The manner in which the initiator is added to the polymerization vessel in the course of the free radical aqueous emulsion polymerization is known to the average person skilled in the art. It may be either completely initially taken in the polymerization vessel or used continuously or stepwise at the rate of its consumption in the course of a free radical emulsion polymerization. Specifically, this depends on the chemical nature of the initiator system as well as on the polymerization temperature. Preferably, a part is initially taken and the remainder is fed to the polymerization zone at the rate of consumption.

For removing the residual monomers, at least one initiator is again added, usually also after the end of the actual emulsion polymerization, i.e. after a conversion of the monomers of at least 95%, and the reaction mixture is heated for a certain time to a polymerization temperature or a temperature above this.

The individual components can be added to the reactor in the feed process from above, at the side or from below through the reactor bottom.

After the (co)polymerization, the acid groups present in the anionic polymer may also be at least partly or completely neutralized. This can be effected, for example, with oxides, hydroxides, carbonates or bicarbonates of alkali metals or alkaline earth metals, preferably with hydroxides, with which any desired counter-ion or a plurality thereof may be associated, e.g. $Li^+$, $Na^+$, $K^+$, $Cs^+$, $Mg^{2+}$, $Ca^{2+}$ or $Ba^{2+}$. Furthermore, ammonia or amines are suitable for the neutralization. Aqueous ammonium hydroxide, sodium hydroxide or potassium hydroxide solutions are preferred.

In the emulsion polymerization, aqueous dispersions of the anionic polymer as a rule with solids contents of from 15 to 75% by weight, preferably from 40 to 75% by weight, are obtained. The molar mass $M_w$ of the anionic polymers is, for example, in the range from 100 000 to 1 million dalton. If the polymers have a gel phase, a molar mass determination is not directly possible. The molar masses are then above the abovementioned range.

The glass transition temperature Tg of the anionic polymers is, for example in the range from −30 to 100° C., preferably in the range from −5 to 70° C. and particularly preferably in the range from 0 to 40° C. (measured by the DSC method according to DIN EN ISO 11357).

The particle size of the dispersed anionic polymers is preferably in the range from 10 to 1000 nm, particularly preferably in the range from 50 to 300 nm (measured using a Malvern® Autosizer 2 C).

The anionic polymer can, if appropriate, comprise small amounts of cationic monomer units incorporated in the form of polymerized units, so that amphoteric polymers are present, but the total charge of the polymers must be anionic. The net anionic charge is, for example, less than −0.2 meq/g. It is generally in the range from −0.5 to −2.0 meq/g. Other suitable anionic polymers are polymer dispersions of nonionic monomers which are emulsified with the aid of anionic surfactants or emulsifiers (such compounds were described above in the case of the emulsion polymerization for the preparation of anionic polymers). For this application, the surfactants or emulsifiers are used, for example, in amounts of from 1 to 15% by weight, based on the total dispersion.

Cationic Polymers

Suitable cationic polymers are all water-soluble cationic polymers mentioned in the prior art cited at the outset. These are, for example, compounds carrying amino or ammonium groups. The amino groups may be primary, secondary, tertiary or quaternary groups. For the polymers, in essence addition polymers, polyaddition compounds or polycondensates are suitable, it being possible for the polymers to have a linear or branched structure, including hyperbranched or dendritic structures. Graft polymers may also be used. In the present context, the cationic polymers are referred to as being water-soluble if their solubility in water under standard conditions (20° C., 1013 mbar) and pH 7.0 is, for example, at least 10% by weight.

The molar masses of $M_w$ of the cationic polymers are, for example, at least 1000. They are, for example, generally in the range from 5000 to 5 million. The charge densities of the cationic polymers are, for example, from 0.5 to 23 meq/g of polymer, preferably from 3 to 22 meq/g of polymer and in general from 6 to 20 meq/g of polymer.

Example of suitable monomers for the preparation of cationic polymers are:

Esters of α,β-ethylenically unsaturated mono- and dicarboxylic acids with amino alcohols, preferably $C_2$-$C_{12}$-amino alcohols. These will be $C_1$-$C_8$-monoalkylated or dialkylated at the amine nitrogen. Suitable acid components of these esters are, for example, acrylic acid, methacrylic acid, fumaric acid, maleic acid, itaconic acid, crotonic acid, maleic anhydride, monobutyl maleate and mixtures thereof. Acrylic acid, methacrylic acid and mixtures thereof are preferably used. These include, for example, N-methylaminomethyl (meth)acrylate, N-methylaminoethyl(meth)acrylate, N,N-dimethylaminomethyl(meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate and N,N-dimethylaminocyclohexyl (meth)acrylate.

Also suitable are the quaternization products of the above compounds with $C_1$-$C_8$-alkyl chlorides, $C_1$-$C_8$-dialkyl sulfates, $C_1$-$C_{16}$-epoxides or benzyl chloride.

In addition, N-[2-(dimethylamino)ethyl]acrylamide, N-[2-dimethylamino)ethyl]methacrylamide, N-[3-(dimethylamino)propyl]acrylamide, N-[3-(dimethylamino)propyl]methacrylamide, N-[4-(dimethylamino)butyl]acrylamide, N-[4-(dimethylamino)butyl]methacrylamide, N-[2-(diethylamino)ethyl]acrylamide, N-[2-(diethylamino)ethyl]methacrylamide and mixtures thereof are suitable as further monomers.

Also suitable are the quaternization products of the above compounds with $C_1$-$C_8$-alkyl chloride, $C_1$-$C_8$-dialkyl sulfate, $C_1$-$C_{16}$-epoxides or benzyl chloride.

Suitable monomers are furthermore N-vinylimidazoles, alkylvinylimidazoles, in particular methylvinylimidazoles, such as 1-vinyl-2-methylimidazole, 3-vinylimidazole N-oxide, 2- and 4-vinylpyridines, 2- and 4-vinylpyridine N-oxides and betaine derivatives and quaternization products of these monomers.

Further suitable monomers are allylamine, dialkyldiallylammonium chlorides, in particular dimethyldiallylammonium chloride and diethyldiallylammonium chloride, and the monomers disclosed in WO-A-01/36500, comprising alkyleneimine units and of the formula

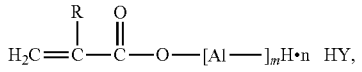

(II)

where

R is hydrogen or $C_1$- to $C_4$-alkyl,

—[Al−]$_m$ is a linear or branched oligoalkyleneimine chain having m alkyleneimine units, m is an integer in the range from 1 to 20, and the number average m in the oligoalkyleneimine chains is at least 1.5, Y is the anion equivalent of a mineral acid and n is a number such that $1 \leq n \leq m$.

Monomers or monomer mixtures in which the number average of m is at least 2.1, in general from 2.1 to 8, in the abovementioned formula are preferred. They are obtainable by reacting an ethylenically unsaturated carboxylic acid with an oligoalkyleneimine, preferably in the form of an oligomer mixture. The resulting product can, if appropriate, be converted with a mineral acid HY into the acid addition salt. Such monomers can be polymerized to give cationic homo- and copolymers in an aqueous medium in the presence of an initiator which initiates a free radical polymerization.

Further suitable cationic monomers are disclosed in the prior European patent application 07 117 909.7. These are aminoalkyl vinyl ethers comprising alkyleneimine units and of the formula (III), where

[Al−]$_n$ is a linear or branched oligoalkyleneimine chain having n alkyleneimine units, n is a number of at least 1 and X is a straight-chain or branched $C_2$- to $C_6$-alkylene group, and salts of the monomers III with mineral acids or organic acids and quaternization products of the monomers III with alkyl halides or dialkyl sulfates. These compounds are obtainable by an addition reaction of alkyleneimines with amino-$C_2$- to $C_6$-alkyl vinyl ethers.

The abovementioned monomers can be polymerized alone to give water-soluble cationic homopolymers or together with at least one other neutral monomer to give water-soluble cationic copolymers or with at least one monomer having acid groups to give amphoteric copolymers which, in the case of a molar excess of cationic monomers incorporated in the form of polymerized units, carry an overall cationic charge.

Suitable neutral monomers which are copolymerized with the abovementioned cationic monomers for the preparation of cationic polymers are, for example, esters of α,β-ethylenically unsaturated mono- and dicarboxylic acids with $C_1$-$C_{30}$-alkanols, $C_2$-$C_{30}$-alkanediols, amides of α,β-ethylenically unsaturated monocarboxylic acids and the N-alkyl and N,N-dialkyl derivatives thereof, esters of vinyl alcohol and allyl alcohol with saturated $C_1$-$C_{30}$-monocarboxylic acids, vinylaromatics, vinyl halides, vinylidene halides, $C_2$-$C_8$-monoolefins and mixtures thereof.

Further suitable comonomers are, for example, methyl (meth)acrylate, methyl ethacrylate, ethyl(meth)acrylate, ethyl ethacrylate, n-butyl(meth)acrylate, isobutyl(meth)acrylate, tert-butyl(meth)acrylate, tert-butyl ethacrylate, n-octyl (meth)acrylate, 1,1,3,3-tetramethylbutyl(meth)acrylate, ethylhexyl(meth)acrylate and mixtures thereof.

Also suitable are acrylamide, substituted acrylamides, methacrylamide, substituted methacrylamides, such as, for example, acrylamide, methacrylamide, N-methyl(meth)acrylamide, N-ethyl(meth)acrylamide, N-propyl(meth)acrylamide, N-(n-butyl)(meth)acrylamide, tert-butyl(meth)acrylamide, n-octyl(meth)acrylamide, 1,1,3,3-tetramethylbutyl (meth)acrylamide and ethylhexyl(meth)acrylamide, and acrylonitrile and methacrylonitrile and mixtures of said monomers.

Further monomers for modifying the cationic polymers are 2-hydroxyethyl(meth)acrylate, 2-hydroxyethyl ethacrylate, 2-hydroxypropyl(meth)acrylate, 3-hydroxypropyl(meth) acrylate, 3-hydroxybutyl(meth)acrylate, 4-hydroxybutyl (meth)acrylate, 6-hydroxyhexyl(meth)acrylate, etc. and mixtures thereof.

Further suitable monomers for the copolymerization with the abovementioned cationic monomers are N-vinyllactams and derivatives thereof which may have, for example, one or more $C_1$-$C_6$-alkyl substituents, such as methyl, ethyl, n-propyl, isopropyl, n-butyl, sec-butyl, tert-butyl, etc. These include, for example, N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam, etc.

Suitable comonomers for the copolymerization with the abovementioned cationic monomers are furthermore ethylene, propylene, isobutylene, butadiene, styrene, α-methylstyrene, vinyl chloride, vinylidene chloride, vinyl fluoride, vinylidene fluoride and mixtures thereof.

A further group of comonomers comprises ethylenically unsaturated compounds which carry a group from which an amino group can be formed in a polymer-analogous reaction. These include, for example, N-vinylformamide, N-vinyl-N-methylformamide, N-vinylacetamide, N-vinyl-N-methylacetamide, N-vinyl-N-ethylacetamide, N-vinylpropionamide, N-vinyl-N-methylpropionamide and N-vinylbutyramide and mixtures thereof. The polymers formed therefrom can, as described in EP-A-0438744, be converted by acidic or basic hydrolysis into polymers comprising vinylamine and amidine units (formulae IV-VII)

(IV)

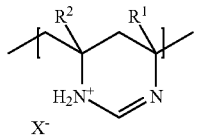

-continued (V)

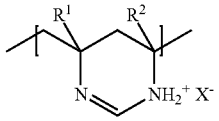

(VI)

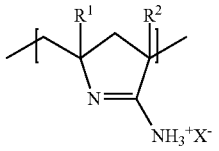

(VII)

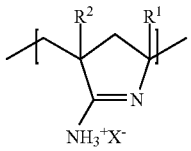

In the formulae IV-VII, the substituents $R^1$, $R^2$ are H, $C_1$- to $C_6$-alkyl and $X^-$ is an anion equivalent of an acid, preferably of a mineral acid.

For example, polyvinylamines, polyvinylmethylamines or polyvinylethylamines form in the hydrolysis. The monomers of this group can be polymerized in any desired manner with the cationic monomers and/or the abovementioned comonomers.

Cationic polymers are also to be understood as meaning amphoteric polymers which carry an overall cationic charge. In the amphoteric polymers, the content of cationic groups is, for example, at least 5 mol % above the content of anionic groups in the polymer. Such polymers are obtainable, for example, by copolymerizing a cationic monomer, such as N,N-dimethylaminoethylacrylamide, in the form of the free base, in the form partly neutralized with an acid or in quaternized form, with at least one monomer comprising acids groups, the cationic monomer being used in a molar excess so that the resulting polymers carry an overall cationic charge.

Amphoteric polymers are also obtainable by copolymerization of (a) at least one N-vinylcarboxamide of the formula (I)

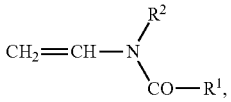

where $R^1$, $R^2$ are H or $C_1$- to $C_6$-alkyl, (b) at least one monoethylenically unsaturated carboxylic acid having 3 to 8 carbon atoms in the molecule and/or the alkali metal, alkaline earth metal or ammonium salts thereof and, if appropriate, (c) other monoethylenically unsaturated monomers and, if appropriate, (d) compounds which have at least two ethylenically unsaturated double bonds in the molecule, and subsequent partial or complete elimination of groups —CO—$R^1$ from the monomers of the formula I which are incorporated in the form of polymerized units in the copolymer, with formation of amino groups, the content of cationic groups, such as amino groups, in the copolymer being at least 5 mol % above the content of acid groups of the monomers (b) incorporated in the form of polymerized units. In the hydrolysis of N-vinylcarboxamide polymers, amidine units form in a secondary reaction by reaction of vinylamine units with a neighboring vinyl formamide unit. Below, the mention of vinylamine units in the amphoteric copolymers always means the sum of vinylamine and amidine units.

The amphoteric compounds thus obtainable comprise, for example, (a) if appropriate, unhydrolyzed units of the formula I,
(b) vinylamine units and amidine units, the content of amino plus amidine groups in the copolymer being at least 5 mol % above the content of monomers comprising acid groups and incorporated in the form of polymerized units,
(c) units of a monoethylenically unsaturated monomer comprising acid groups and/or the alkali metal, alkaline earth metal or ammonium salts thereof,
(d) from 0 to 30 mol % of units of at least one other monoethylenically unsaturated monomer and
(e) from 0 to 2 mol % of at least one compound which has at least two ethylenically unsaturated double bonds in the molecule.

The hydrolysis of the copolymers can be carried out in the presence of acids or bases or enzymatically. In the hydrolysis with acids, the vinylamine groups forming from the vinylcarboxamide units are present in salt form. The hydrolysis of vinylcarboxamide copolymers is described in detail in EP-A-0 438 744, page 8, line 20 to page 10, line 3. The statements made there apply accordingly for the preparation of the amphoteric polymers to be used according to the invention and having an overall cationic charge.

These polymers have, for example, K values (determined after H. Fikentscher in 5% strength aqueous sodium chloride solution at pH 7, a polymer concentration of 0.5% by weight and a temperature of 25° C.) in the range from 20 to 250, preferably from 50 to 150.

The preparation of the cationic homo- and copolymers can be effected by solution, precipitation, suspension or emulsion polymerization. Solution polymerization in the aqueous media is preferred. Suitable aqueous media are water and mixtures of water and at least one water-miscible solvent, for example an alcohol, such as methanol, ethanol, n-propanol, etc.

The polymerization temperatures are preferably in a range from about 30 to 200° C., particularly preferably from 40 to 110° C. The polymerization is usually effected under atmospheric pressure but can also take place under reduced or superatmospheric pressure. A suitable pressure range is from 0.1 to 5 bar.

For the preparation of the polymers, the monomers can be polymerized with the aid of free radical initiators.

Free radical polymerization initiators which may be used are the peroxo and/or azo compounds customary for this purpose, for example alkali metal or ammonium peroxodisulfate, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumyl hydroperoxide, diisopropyl peroxydicarbamate, bis(o-toluyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, azobisisobutyronitrile, azobis(2-amidinopropane)dihydrochloride or 2-2'-azobis(2-methylbutyronitrile). Also suitable are initiator mixtures or redox initiator systems, such as, for example, ascorbic acid/iron(II) sulfate/sodium peroxodisulfate, tert-butyl hydroperoxide/sodium disulfite, tert-butyl hydroperoxide/sodium hydroxymethanesulfinate, $H_2O_2$/Cu(I) or iron(II) compounds.

For adjusting the molecular weight, the polymerization can be effected in the presence of at least one regulator. Regulators which may be used are the customary compounds known to the person skilled in the art, such as for example sulfur compounds, e.g. mercaptoethanol, 2-ethylhexyl thioglycolate, or thioglycolic acid, sodium hypophosphite, formic acid or dodecyl mercaptan and tribromochloromethane or other compounds which regulate the molecular weight of the polymers obtained.

Cationic polymers, such as polyvinylamines and copolymers thereof, can also be prepared by Hofmann degradation of polyacrylamide or polymethacrylamide and copolymers thereof, cf. H. Tanaka, Journal of Polymer Science: Polymer Chemistry edition 17, 1239-1245 (1979) and El Achari, X. Coqueret, A. Lablache-Combier, C. Loucheux, Makromol. Chem., Vol. 194, 1879-1891 (1993).

All the abovementioned cationic polymers can be modified by carrying out the polymerization of the cationic monomers and, if appropriate, of the mixtures of cationic monomers and the comonomers in the presence of at least one crosslinking agent. As already described in the case of the anionic polymers, a crosslinking agent is understood as meaning those monomers which comprise at least two double bonds in the molecule, e.g. methylenebisacrylamide, glycol diacrylate, glycol dimethacrylate, glyceryl triacrylate, pentaerythritol triallyl ether, polyalkylene glycols which are at least diesterified with acrylic acid and/or methacrylic acid or polyols such as pentaerythritol, sorbitol or glucose. If at least one crosslinking agent is used in the copolymerization, the amounts used are, for example, up to 2 mol %, e.g. from 0.001 to 1 mol %.

Furthermore, the cationic polymer can be modified by the subsequent addition of crosslinking agents, i.e. by the addition of compounds which have at least 2 groups reactive to amino groups, such as, for example, di- and polyglycidyl compounds,
di- and polyhalogen compounds,
compounds having 2 or more isocyanate groups, possibly blocked carbonic acid derivatives,
compounds which have 2 or more double bonds which are suitable for a Michael addition,
di- and polyaldehydes,
monoethylenically unsaturated carboxylic acids and the esters and anhydrides thereof.

Suitable cationic compounds are moreover polymers which can be produced by polyaddition reactions, such as, in particular, polymers based on aziridines. It is possible both for homopolymers to form but also graft polymers, which are produced by grafting of aziridines on other polymers. It may also be advantageous here to add, during or after the polyaddition, crosslinking agents which have at least 2 groups which can react with the aziridines or the amino groups formed, such as, for example, epichlorohydrin or dihaloalkanes (cf. Ullmann's Encyclopedia of Industrial Chemistry, VCH, Weinheim, 1992, chapter on aziridines).

Preferred polymers of this type are based on ethyleneimine, for example homopolymers of ethyleneimine which are prepared by polymerization of ethyleneimine or polymers grafted with ethyleneimine, such as polyamidoamines.

Further suitable cationic polymers are reaction products of dialkylamines with epichlorohydrin or with di- or polyfunctional epoxides, such as, for example, reaction products of dimethylamine with epichlorohydrin.

Other suitable cationic polymers are polycondensates, e.g. homo- or copolymers of lysine, arginine and histidine. They can be used as homopolymers or as copolymers with other natural or synthetic amino acids or lactams. For example, glycine, alanine, valine, leucine, phenylalanine, tryptophan, proline, asparagine, glutamine, serine, threonine or caprolactam are suitable for the copolymerization.

Furthermore, condensates of difunctional carboxylic acids with polyfunctional amines may be used as cationic polymers, the polyfunctional amines carrying at least 2 primary amino groups and at least one further less reactive, i.e. secondary, tertiary or quaternary, amino group. Examples are the polycondensation products of diethylenetriamine or triethylenetetramine with adipic, malonic, glutaric, oxalic or succinic acid.

Polysaccharides carrying amino groups, such as, for example, chitosan, are also suitable as cationic polymers.

Furthermore, all the polymers which are described above and carry primary or secondary amino groups can be modified by means of reactive oligoethyleneimines, as described in the prior European patent application 07 150 232.2. This application describes graft polymers whose grafting base is selected from the group consisting of polymers having vinylamine units, polyamines, polyamidoamines and polymers of ethylenically unsaturated acids and which comprise, as side chains, exclusively oligoalkyleneimine side chains. The preparation of graft polymers having oligoalkyleneimine side chains is effected by grafting at least one oligoalkyleneimine which comprises a terminal aziridine group onto one of said grafting bases.

Papermaking

Suitable fibers for the production of pulps are all qualities customary for this purpose, e.g. mechanical pulp, bleached and unbleached chemical pulp and paper stocks from all annual plants. Mechanical pulp includes, for example, groundwood, thermomechanical pulp (TMP), chemothermomechanical pulp (CTMP), pressure groundwood, semichemical pulp, high-yield chemical pulp and refiner mechanical pulp (RMP). For example, sulfate, sulfite and soda pulps are suitable as chemical pulp. Preferably unbleached chemical pulp, which is also referred to as unbleached kraft pulp, is used. Suitable annual plants for the production of paper stocks are, for example, rice, wheat, sugarcane, and kenaf. Pulps are generally produced using wastepaper, which is used either alone or as a mixture with other fibers, or fiber mixtures comprising a primary pulp and recycled coated waste, e.g. bleached pine sulfate mixed with recycled coated waste, are used as starting materials. The process according to the invention is of industrial interest for the production of paper and board from waste paper because it substantially increases the strength properties of the recycled fibers and is particularly important for improving strength properties of graphic arts papers and of packaging papers. The papers obtainable by the process according to the invention surprisingly have a higher dry strength than the papers which can be produced by the process of WO 2006/056381.

The pH of the stock suspension is, for example, in the range from 4.5 to 8, in general from 6 to 7.5. For example, an acid, such as sulfuric acid, or aluminum sulfate can be used for adjusting the pH.

In the process according to the invention, preferably the cationic polymer is first metered to the paper stock. The cationic polymer can be added to the high-density stock (fiber concentration >15 g/l, e.g. in the range from 25 to 40 g/l up to 60 g/l) or preferably to a low-density stock (fiber concentration <15 g/l, e.g. in the range from 5 to 12 g/l). The point of addition is preferably before the wires but may also be between a shearing stage and a screen or thereafter. The anionic component is generally added to the paper stock only after the addition of the cationic component, but may also be metered to the paper stock simultaneously, but separately from the cationic component. Furthermore, it is also possible to add first the anionic and then the cationic component.

A process variant in which the paper stock is heated to a temperature of at least 40° C., e.g. from 45 to 55° C., preferably to at least 50° C., and thereafter the water-soluble cationic polymer and thereafter or simultaneously, but separately from one another, the water-insoluble anionic polymer is metered is particularly advantageous. However, it is also possible first to meter the water-insoluble anionic polymer and then the water-soluble cationic polymer into the paper stock heated to at least 40° C. Preferably, a polymer having vinylamine units is used as the water-soluble cationic polymer.

The cationic polymer is used, for example, in an amount of from 0.03 to 2.0% by weight, preferably from 0.1 to 0.5% by weight, based on dry paper stock. The water-insoluble anionic polymer is used, for example, in an amount of from 0.5 to 10% by weight, preferably from 1 to 6% by weight, in particular from 2.5 to 5.5% by weight, based on dry paper stock.

The weight ratio of water-soluble cationic polymer to water-insoluble anionic polymer is, relating to the solids content, for example, from 1:5 to 1:20 and is preferably in the range from 1:10 to 1:15 and particularly preferred from 1:10 to 1:12.

In the process according to the invention, the process chemicals usually used in papermaking can be used in the customary amounts, e.g. retention aid, draining agent, other dry strength agents, such as, for example, starch, pigments, fillers, optical brighteners, antifoams, biocides and paper dyes.

Unless stated otherwise, the reported percentages in the examples are percent by weight. The K value of the polymers was determined according to Fikentscher, Cellulose-Chemie, volume 13, 58-64 and 71-74 (1932) at a temperature of 20° C. in 5% strength by weight aqueous sodium chloride solutions at a pH of 7 and a polymer concentration of 0.5%. In this context, $K=k\cdot 1000$.

For the individual tests, sheets were produced in laboratory experiments in a Rapid Köthen laboratory sheet former. The dry breaking length was determined according to DIN 53 112, sheet 1. The determination of the CMT value was effected according to DIN 53 143 and that of the dry bursting pressure according to DIN 53 141.

EXAMPLES

The following polymers were tested in the examples and comparative examples:

Cationic Polymer A

This polymer was prepared by hydrolysis of a poly-N-vinylformamide with hydrochloric acid. The degree of hydrolysis of the polymer was 50 mol %, i.e. the polymer comprised 50 mol % of N-vinylformamide units and 50 mol % of vinylamine units in salt form. The K value of the water-soluble cationic polymer was 90.

Cationic Polymer B

Preparation as described under polymer A but with the exception that the degree of hydrolysis of the polymer was 30 mol %. The water-soluble cationic polymer comprised 70 mol % of N-vinylformamide units and 30 mol % of vinylamine units in salt form. The K value of the water-soluble cationic polymer was 90.

Preparation of a Paper Stock Suspension

A 0.5% strength aqueous stock suspension was prepared from 100% mixed wastepaper. The pH of the suspension was 7.1 and the freeness of the stock was 50° Schopper-Riegler (° SR). The stock suspension was then divided into 8 equal parts and processed in examples 1 to 3 and in comparative examples 1 to 5 under the conditions stated in each case in the examples and comparative examples on a Rapid-Köthen sheet former according to ISO 5269/2 to give sheets having a basis weight of 120 g/m$^2$.

Example 1

The paper stock was heated to a temperature of 50° C. 0.25% of polymer B (polymer solid, based on dry fiber) was added to the stock suspension heated in this manner. After a reaction time of 5 minutes, the dispersion of an anionic acrylate resin (solids content 50%), obtainable by suspension polymerization of 68 mol % of n-butyl acrylate, 14 mol % of styrene, 14 mol % of acrylonitrile and 4 mol % of acrylic acid, was diluted by a factor of 10. The mean particle size of the dispersed polymer particles was 192 nm. Thereafter, the dilute dispersion was metered with gentle stirring into the fiber suspension heated to 50° C. The amount of acrylate resin used was 5% (polymer solid), based on dry fiber. After a reaction time of 1 minute, sheets were formed and were then dried for 7 minutes at 90° C.

Example 2

A further sample of the paper stock suspension described above was treated at a stock temperature of 22° C. with 0.25% of polymer B (polymer solid, based on dry fiber). After a residence time of 5 minutes, the dispersion of an anionic acrylate resin (solids content 50%) obtainable by suspension polymerization of 68 mol % of n-butyl acrylate, 14 mol % of styrene, 14 mol % of acrylonitrile and 4 mol % of acrylic acid, was diluted by a factor of 10. The mean particle size of the dispersed polymer particles was 192 nm. Thereafter, the dilute dispersion, the temperature of which was about 20° C., was metered with gentle stirring into the fiber stock suspension, which had a temperature of 22° C. The amount of acrylate resin used was 5% (polymer solid), based on dry fiber. After a reaction time of 1 minute, sheets were formed and were then dried for 7 minutes at 90° C.

Example 3

The dispersion of an anionic acrylate resin (solids content 50%), obtainable by suspension polymerization of 68 mol % of n-butyl acrylate, 14 mol % of styrene, 14 mol % of acrylonitrile and 4 mol % of acrylic acid, was diluted by a factor of 10. Thereafter, the dilute dispersion was added with gentle stirring to the fiber suspension. The amount of acrylate resin used was 5% (polymer solid), based on dry fiber. The mean particle size of the dispersed particles was 192 nm. The fiber suspension pretreated with the dispersion was then heated to 50° C. 0.25% of polymer B (polymer solid, based on dry fiber) was metered into the heated stock suspension. After a reaction time of 1 minute, sheets were formed and were then dried for 7 minutes at 90° C.

Comparative Example 1

A sheet was formed from the above-described stock suspension, which had a temperature of 20° C., without further additives.

Comparative examples 2 to 4 were carried out according to example 1 of WO 2006/056381.

Comparative Example 2

0.25% of polymer A (polymer solid, based on dry fiber) was added to a sample of the paper stock suspension described above at a stock temperature of 22° C. After a residence time of 5 minutes, 0.25% of a water-soluble copolymer of 30% acrylic acid and 70% vinylformamide was added. The copolymer was present in the form of a sodium salt and had a K value of 90. After a reaction time of 1 minute, sheets were formed and were then dried for 7 minutes at 90° C.

Comparative Example 3

0.25% of polymer B (polymer solid, based on dry fiber) was added to a further sample of the paper stock suspension described above at a stock temperature of 22° C. After a residence time of 5 minutes, 0.5% of a water-soluble copolymer of 30% acrylic acid and 70% vinylformamide was added. The copolymer was present in the form of a sodium salt and had a K value of 90. After a reaction time of 1 minute, sheets were formed and were then dried for 7 minutes at 90° C.

Comparative Example 4

1% of polymer B (polymer solid, based on dry fiber) was added to a further sample of the paper stock suspension described above at a stock temperature of 22° C. After a residence time of 5 minutes, 1% of a water-soluble copolymer of 30% acrylic acid and 70% vinylformamide was added. The copolymer was present in the form of a sodium salt and had a K value of 90. After a reaction time of 1 minute, sheets were formed and were then dried for 7 minutes at 90° C.

Comparative Example 5

0.25% of polymer B (polymer solid, based on dry fiber) was added to a further sample of the paper stock suspension described above at a stock temperature of 50° C. After a residence time of 5 minutes, 0.5% of a water-soluble copolymer of 30% acrylic acid and 70% vinylformamide was added. The copolymer was present in the form of a sodium salt and had a K value of 90. After a reaction time of 1 minute, sheets were formed and were then dried for 7 minutes at 90° C.

Testing of the Paper Sheets Produced According to Examples 1 to 3 and Comparative Examples 1 to 5

After the sheets produced according to the examples and comparative examples had been stored for 12 hours in a conditioned chamber at a constant temperature of 23° C. and 50% atmospheric humidity, in each case the dry breaking length of the sheets was determined according to DIN 54540. The determination of the CMT value of the conditioned sheets was effected according to DIN 53 143 and that of the dry bursting pressure of the sheets was determined according to DIN 53 141. The results are stated in table 1.

TABLE 1

| Example | Dry breaking length (m) | Bursting pressure [kPa] | CMT30 [N] |
|---|---|---|---|
| 1 | 5213 | 532 | 251 |
| 2 | 4844 | 474 | 233 |
| 3 | 5134 | 511 | 235 |
| Comparative example 1 | 3598 | 307 | 141 |
| Comparative example 2 | 4011 | 361 | 176 |
| Comparative example 3 | 4678 | 401 | 217 |
| Comparative example 4 | 4768 | 443 | 231 |
| Comparative example 5 | 4489 | 383 | 211 |

We claim:

1. A process for producing paper, board, or cardboard having high dry strength, the process comprising:

separately adding a water-soluble cationic polymer and an anionic polymer to a paper stock;

draining the paper stock, to give a paper product and drying of the paper product, wherein the anionic polymer is at least one selected from the group consisting of an aqueous dispersion of a water-insoluble polymer having a content of acid groups of not more than 10 mol %, and an aqueous dispersion of a nonionic polymer, which aqueous dispersion has been made anionic.

2. The process according to claim 1, wherein the water-insoluble polymer has a content of acid groups of from 0.1 to 9 mol %.

3. The process according to claim 2, wherein the water-insoluble polymer has a content of acid groups of from 0.5 to 6 mol %.

4. The process according to claim 3, wherein the water-soluble polymer has a content of acid groups of from 2 to 6 mol %.

5. The process according to claim 2, wherein the water-soluble polymer has a content of acid groups of from 2 to 6 mol %.

6. The process according to claim 2, wherein the acid groups are selected from the group consisting of carboxyl groups, sulfophonic acid groups, and phosphonic acid groups.

7. The process according to claim 1, wherein the water-insoluble polymer has a content of acid groups of from 0.5 to 6 mol %.

8. The process according to claim 7, wherein the water-soluble polymer has a content of acid groups of from 2 to 6 mol %.

9. The process according to claim 7, wherein the acid groups are selected from the group consisting of carboxyl groups, sulfophonic acid groups, and phosphonic acid groups.

10. The process according to claim 1, wherein the water-soluble polymer has a content of acid groups of from 2 to 6 mol %.

11. The process according to claim 1, wherein the acid groups are selected from the group consisting of carboxyl groups, sulphonic acid groups, and phosphonic acid groups.

12. The process according to claim 1, wherein the anionic polymer comprises, in polymerized form:

(a) at least one monomer selected from the group consisting of a $C_1$- to $C_{20}$-alkyl acrylate, a $C_1$- to $C_{20}$-alkyl methacrylate, a vinyl ester of a saturated carboxylic acid comprising up to 20 carbon atoms, a vinylaromatic having up to 20 carbon atoms, an ethylenically unsaturated nitrile, a vinyl ether of a saturated, monohydric alcohol comprising 1 to 10 carbon atoms, a vinyl halide and an aliphatic hydrocarbon having 2 to 8 carbon atoms and one or two double bonds;

(b) at least one anionic monomer selected from the group consisting of an ethylenically unsaturated C3- to C8-carboxylic acid, vinylsulfonic acid, acrylamido-2-methylpropanesulfonic acid, styrenesulfonic acid, vinylphosphonic acid, a salt of an ethylenically unsaturated C3- to C8 carboxylic acid, a salt of vinylsulfonic acid, a salt of acrylamido-2-methylpropanesulfonic acid, a salt of styrenesulfonoic acid, and a salt of vinylphosphoinic acid; optionally, (c) at least one monomer selected from the group consisting of a $C_1$- to $C_{10}$-hydroxyalkyl acrylate, a $C_1$- to $C_{10}$-hydroxyalkyl methacrylate, acrylamide, methacrylamide, a N—$C_1$- to $C_{20}$-alkylacrylamide, and an N—$C_1$- to $C_{20}$-alkylmethacrylamide; and, optionally, (d) at least one monomer having at least two ethylenically unsaturated double bonds in the molecule.

13. The process according to claim 1, wherein the anionic polymer comprises, in polymerized form:

(a) at least 60 mol % of at least one monomer selected from the group consisting of a $C_1$- to $C_{20}$-alkyl acrylate, a $C_1$- to $C_{20}$-alkyl methacrylate, vinyl acetate, vinyl propionate, styrene, .alpha.-methylstyrene, p-methylstyrene, α-butylstyrene, 4-n-butylstyrene, 4-n-decylstyrene, acrylonitrile, methacrylonitrile, butadiene, and isoprene; and (b) from 0.5 to 9 mol % of at least one anionic monomer which is an ethylenically unsaturated $C_3$- to $C_5$-carboxylic acid.

14. The process according to claim 1, wherein the anionic polymer comprises, in polymerized form, at least 80 mol % of at least one monomer selected from the group consisting of (a) at least one monomer selected from the group consisting of a $C_1$- to $C_{20}$-alkyl acrylate, a $C_1$- to $C_{20}$-alkyl methacrylate, a vinyl ester of a saturated carboxylic acid comprising up to 20 carbon atoms, a vinylaromatic having up to 20 carbon atoms, an ethylenically unsaturated nitrile, a vinyl ether of a saturated, monohydric alcohol comprising 1 to 10 carbon atoms, a vinyl halide, and an aliphatic hydrocarbon having 2 to 8 carbon atoms and one or two double bonds.

15. The process according to claim 14, wherein the anionic polymer comprises, in polymerized form as (a), a mixture of (i) a $C_1$- to $C_{20}$-alkyl acrylate and/or a $C_1$- to $C_{20}$-alkyl methacrylate, and (ii) styrene, α-methylstyrene, p-methylstyrene, α-butylstyrene, 4-n-butylstyrene, butadiene, and/or isoprene, in a weight ratio of from 10:90 to 90:10.

16. The process according to claim 1, wherein the anionic polymer has a glass transition temperature $T_g$ of from −30 to 100° C., measured according to DIN EN ISO 11357.

17. The process according to claim 1, wherein the anionic polymer has a glass transition temperature of from −5 to 70° C.

18. The process according to claim 1, wherein a temperature of the paper stock is at least 40° C.

19. The process according to claim 1, wherein a temperature of the paper stock is at least 50° C.

20. The process according to claim 1, wherein a polymer having polymerized vinylamine units is the water-soluble cationic polymer.

* * * * *